US006978593B2

(12) United States Patent
Delvael

(10) Patent No.: US 6,978,593 B2
(45) Date of Patent: Dec. 27, 2005

(54) COMPOSITE SYNTHETIC STRING FOR TENNIS RACKET

(75) Inventor: Yves Delvael, Wervik (BE)

(73) Assignee: Cousin Biotech, Wervicq Sud (FR)

( * ) Notice: Subject to any disclaimer, the term of this patent is extended or adjusted under 35 U.S.C. 154(b) by 0 days.

(21) Appl. No.: 10/258,971

(22) PCT Filed: May 4, 2001

(86) PCT No.: PCT/FR01/01371

§ 371 (c)(1),
(2), (4) Date: Apr. 2, 2003

(87) PCT Pub. No.: WO01/85268

PCT Pub. Date: Nov. 15, 2001

(65) Prior Publication Data

US 2003/0145574 A1 Aug. 7, 2003

(30) Foreign Application Priority Data

May 9, 2000 (FR) ..... 00 05848

(51) Int. Cl.[7] ..... D02G 3/02
(52) U.S. Cl. ..... 57/232
(58) Field of Search ..... 57/210, 231, 232, 57/234, 243, 244, 250, 251; 428/371, 407

(56) References Cited

U.S. PATENT DOCUMENTS

| | | | | |
|---|---|---|---|---|
| 3,048,078 | A * | 8/1962 | Kaplan et al. | 87/1 |
| 3,496,717 | A * | 2/1970 | Costello et al. | 57/7 |
| 4,055,941 | A | 11/1977 | Rivers, Jr. et al. | |
| 5,145,172 | A | 9/1992 | Takashima | |
| 6,009,699 | A | 1/2000 | Delvael | |

FOREIGN PATENT DOCUMENTS

| | | |
|---|---|---|
| EP | 0049 196 A1 | 4/1982 |
| FR | 2 581 094 | 4/1985 |
| FR | 2 770 140 | 10/1997 |

OTHER PUBLICATIONS

D. Hull, An Introduction to Composite Materials, 1996, Cambridge University Press, 2nd edition, pp. 23, 24, 30-33.*

* cited by examiner

*Primary Examiner*—John J. Calvert
*Assistant Examiner*—Shaun R. Hurley
(74) *Attorney, Agent, or Firm*—Leydig, Voit & Mayer, Ltd.

(57) ABSTRACT

The invention concerns a composite synthetic delaminated string in particular for a tennis racket. The string includes central monofilaments surrounded by multifilament yarns, the assembly being impregnated and coated with polyurethane and is subjected to tensile bending after it has been formed. The invention is useful for tennis strings with novel appearance, with long life span and quick reaction when hitting a ball.

11 Claims, 1 Drawing Sheet

COMPOSITE SYNTHETIC STRING FOR TENNIS RACKET

FIELD OF THE INVENTION

The present invention relates to a composite synthetic string, which is intended in particular but not exclusively for the stringing of tennis rackets.

BACKGROUND OF THE INVENTION

Some composite synthetic strings are already known. Described in FR-A-2 491 098 is a synthetic string with two components: polyamide multifilament threads and polyurethane, the multifilaments being integrated in a matrix of polyurethane. The polyurethane binder, whose elastic behavior is quite superior to that of polyamide, makes it possible to obtain, with a particular structure of the string, a high breaking strength and an average hardness expressed by rapid return of the string to its initial position after impact of a ball.

BRIEF SUMMARY OF THE INVENTION

The present invention relates to using this advantage and considerably lengthening the life span of the tennis strings, even when used with rackets with a rigid frame, while having an original appearance.

According to the present invention, the synthetic composite string, particularly for a tennis racket, having threads of a first synthetic material and a binder made of a second synthetic material impregnating to the core, connecting and covering said threads, which are spirally wound, the melting point of the binder being less than that of the threads and its elasticity much higher, said threads being made up of multifilaments, is characterized by the fact that at least one monofilament with two flat sides is arranged in the center of the string, this string undergoing a tensile bending after its formation.

According to another characteristic of the invention, the string is characterized by the fact that the oblong monofilament appears as a contrasted spiral through the transparent binder.

A single flat central thread is sufficient for obtaining the desired effect. Preferably, the central monofilaments are oblong monofilaments with a very high toughness, whose cross section has a general rectangular shape with rounded edges. They constitute a core of the string in a way. It is also possible to provide a few small monofilaments arranged at the periphery of the string in order to resist abrasion. The central monofilament (or bundle of multifilaments) can be colored in order to increase the luminous effect of iridescence. It is also possible to color the mass of polyurethane or binder.

Other characteristics and advantages of the invention will appear in the course of the following description of a particular embodiment given only as a nonlimiting example, with regard to the drawings which represent:

DETAILED DESCRIPTION OF THE INVENTION

Figure 1:
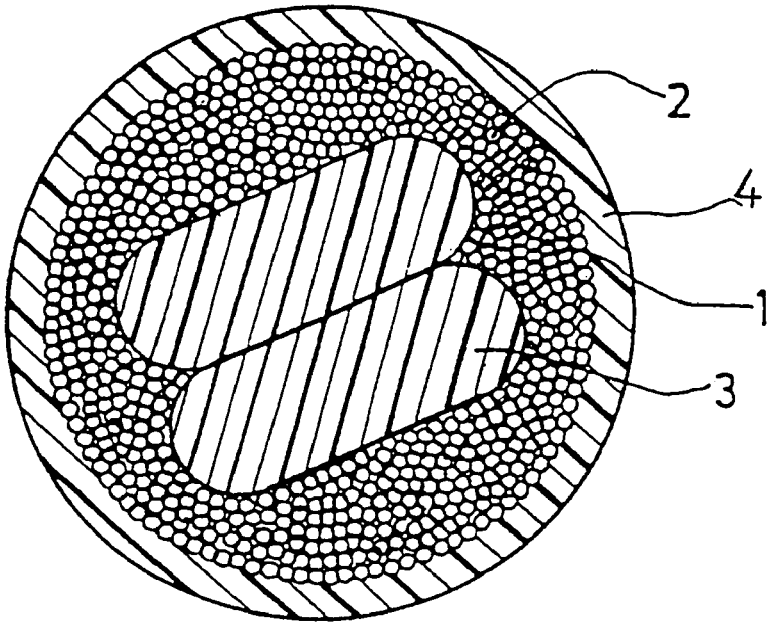
FIG. 1, a cross section of a string according to the present invention.
Figure 2:
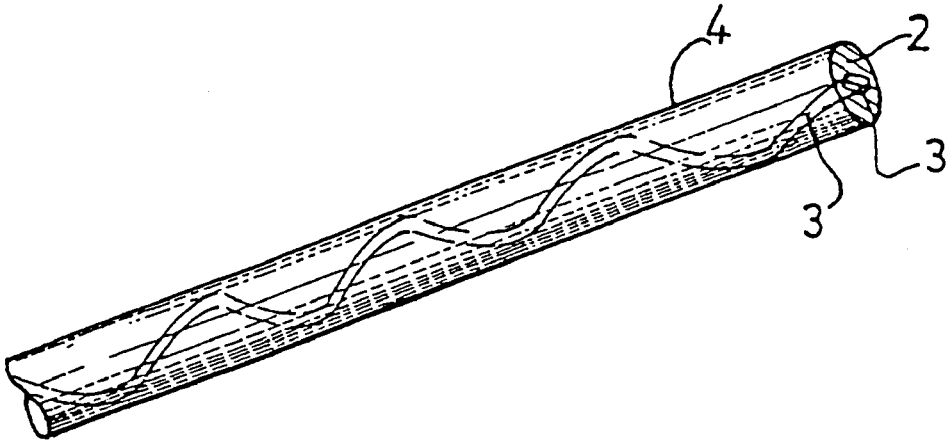
FIG. 2, a view of a string according to the invention.

In FIG. 1, it is seen that the string according to the invention is composed of polyurethane 1, forming the matrix of the string and impregnating and surrounding the multifilaments and the monofilaments. The polyurethane is found between multifilaments 2 and central monofilaments 3 and thus forms a homogeneous assembly. It also forms rind 4 or exterior envelope layer of the string. Distributed inside of the matrix of multifilaments, in the center of their mass, are oblong monofilaments 3 which, in the example represented, are two in number. But in all cases, monofilaments 3 are connected with multifilaments 2 by the polyurethane matrix.

Monofilaments 3 also take on the dynamic work of the string. The string according to the invention, furthermore stiffened by the presence of monofilaments, is easier to string up.

Multifilaments 2, as well as monofilaments 3, consist of polyamide known under the name "nylon 6.6," whose shore hardness "D" is 85, or other polyamides and copolyamides.

The process of manufacturing by twisting of such a string is conventional, that is to say, it consists of coating monofilaments and multifilaments before twisting, and then twisting them with a level of torsion of 50–200 turns/meter, the string being, after twisting and evaporation of the solvent, run through a die for contour regularization and evacuation of the excess polyurethane. After which, a tensile bending is exerted on the string which produces delamination and causes the central monofilaments to appear through the polyurethane.

The spools of multifilaments and oblong monofilaments are mounted on a rotating tray on which the threads are coated with a solution of polyurethane. The threads go into a furnace which evaporates the solvent and prepolymerizes the polyurethane. Then, the threads are thrown in a ring, and the binder is definitively polymerized in a furnace, after which traction is exerted on the thread in order to obtain the desired effect. The string can thus be constructed in a single operation without restarts.

The tensile bending exerted on the string, for example, by means of a capstan, or by passage over an axle or through a squeezing die, causes delamination which makes the spiral of the central monofilaments appear as a helix through the transparent polyurethane. The pitch of the spiral is a function of the twisting.

It has been observed that the strings according to the invention have a sound, during impact of a ball, which is similar to that of natural gut.

EXAMPLE

The string represented in FIG. 1 has a diameter of 1.30 mm and has a breaking strength greater than 80 daN. Its elongation at break is on the order of 25%, and its weight is 1.5 g per meter. It is composed of two 2200 decitex oblong monofilaments which, in the course of twisting, are spirally wound, and of four multifilament threads, including 140 filaments each whose diameter is 28 microns. The assembly of the threads is twisted at a rate of 80 turns/meter.

Although, in the preceding description, the multifilaments and the monofilaments are made of polyamide, this material can be replaced by any other synthetic material having good dynamic characteristics, such as polyester, for example. The central monofilament threads can have any cross section provided that they have flat sides so that the contact between the two threads can occur over a nonlocalized area.

It goes without saying that numerous variants can be provided, particularly by substitution of technically equivalent means without consequently diverging from the scope of the invention.

What is claimed is:

1. A synthetic composite delaminated string for a tennis racket comprising:

threads comprising a first synthetic material and including multifilaments, the threads being spirally wound;

a transparent binder comprising a second synthetic material, the binder impregnating the string and connecting and covering the threads, the binder having a melting point that is less than that of the threads, and having an elasticity that is higher than that of the threads;

the string having a center, and including at least one monofilament with two flat sides arranged in the center of the string;

wherein the binder impregnated string underwent tensile bending to produce the synthetic composite delaminated string wherein the monofilament is separated from the surrounding synthetic material so that the monofilament appears as a contrasted spiral through the transparent binder and multifilaments.

2. The composite delaminated string according to claim 1, wherein the at least one monofilament comprises an oblong monofilament, the oblong monofilament appearing as a contrasted spiral through the transparent binder and multifilaments.

3. The composite delaminated string according to claim 2, wherein the at least one monofilament and the multifilaments comprise polyamide, and the binder consists of polyurethane.

4. The composite delaminated string according to claim 1, wherein the at least one monofilament and the multifilaments comprise polyamide, and the binder consists of polyurethane.

5. The composite delaminated string according to claim 1, wherein the binder impregnated string underwent tensile bending by means of a capstan, passage over an axle, or passage through a squeezing die.

6. A synthetic composite delaminated string for a tennis racket produced by a method comprising:

winding threads spirally to form a string having a center, wherein the threads comprise a first synthetic material and multifilaments and wherein the string includes at least one monofilament with two flat sides arranged in the center of the string;

connecting and covering the threads and impregnating the string with a transparent binder comprising a second synthetic material, wherein the binder has a melting point that is less than that of the threads and an elasticity that is higher than that of the threads; and delaminating the binder impregnated string through tensile bending to produce the synthetic composite delaminated string having a monofilament that is visible as a contrasted spiral through the transparent binder and multifilaments.

7. The synthetic composite delaminated string according to claim 6, wherein the binder impregnated string underwent tensile bending that separated the monofilament from the surrounding synthetic material so that the monofilament appears as a contrasted spiral through the transparent binder and multifilaments.

8. The composite delaminated string according to claim 6, wherein the at least one monofilament comprises an oblong monofilament.

9. The composite delaminated string according to claim 8, wherein the at least one monofilament and the multifilaments comprise polyamide, and the binder consists of polyurethane.

10. The composite delaminated string according to claim 6, wherein the at least one monofilament and the multifilaments comprise polyamide, and the binder consists of polyurethane.

11. The composite delaminated string according to claim 6, wherein the binder impregnated string is delaminated through tensile bending by means of a capstan, passage over an axle or passage through a squeezing die.

* * * * *